US006645101B1

(12) United States Patent
Wong

(10) Patent No.: US 6,645,101 B1
(45) Date of Patent: Nov. 11, 2003

(54) TRANSFORMABLE BALL

(75) Inventor: Tak Ko Wong, Chaiwan (HK)

(73) Assignee: T. K. Wong and Associates Ltd., Chaiwan (HK)

( * ) Notice: Subject to any disclaimer, the term of this patent is extended or adjusted under 35 U.S.C. 154(b) by 0 days.

(21) Appl. No.: 10/189,467

(22) Filed: Jul. 8, 2002

(51) Int. Cl.[7] ..... A63B 43/00
(52) U.S. Cl. ..... 473/614; 473/594
(58) Field of Search ..... 473/594, 577, 473/614, 603; 446/339, 199, 71, 73, 72, 75, 76, 486, 176, 180, 183, 184

(56) References Cited

U.S. PATENT DOCUMENTS 4,614,505 A * 9/1986 Schneider et al. ..... 446/372
5,522,757 A * 6/1996 Ostrowski ..... 473/594
5,791,963 A * 8/1998 Lieberman ..... 446/76
5,921,840 A * 7/1999 Diresta et al. ..... 473/594
6,109,998 A * 8/2000 DiResta et al. ..... 446/184
6,500,082 B1 * 12/2002 Ou ..... 473/599

* cited by examiner

*Primary Examiner*—Steven Wong
(74) *Attorney, Agent, or Firm*—Leydig, Voit & Mayer, Ltd.

(57) ABSTRACT

A recreational ball has a self-supporting flexible wall surrounding an internal space. One side of the wall has first features that extend into or at least face the internal space, and the other side of the wall has second features at the ball exterior. A hole in the flexible wall allows the first features to pass to the ball exterior as the ball is turned inside-out.

13 Claims, 2 Drawing Sheets

TRANSFORMABLE BALL

BACKGROUND OF THE INVENTION

The present invention relates to recreational balls. More particularly, the invention relates to a recreational ball that is transformable to an inside-out configuration to thereby change its appearance and/or function.

Many types of recreational balls are known. Some are solid, such as billiard balls and cricket balls, whereas others, such as footballs and tennis balls are hollow.

OBJECTS OF THE INVENTION

Although the present invention does not aim specifically at addressing any problems known with such recreational balls, it aims at providing a soft recreational ball that can be turned inside-out to thereby change its appearance and/or function.

DISCLOSURE OF THE INVENTION

There is disclosed herein a recreational ball comprising:

a self-supporting flexible wall substantially surrounding an internal space, one side of the wall having first features that extend into or at least face said internal space, and the other side of the wall having second features at the ball exterior, and a hole in said flexible wall, through which said first features can pass to the ball exterior as the ball is turned inside-out.

Preferably the first features are of different overall appearance than the second features.

Preferably the ball is made of highly elastic material.

Preferably said material is a gelatinous composition produced by a melt blend of a copolymer and plasticising oils.

Preferably the copolymer is a poly (styrene-ethylene-butylene-styrene) triblock copolymer.

Preferably tackiness or stickiness in the gelatinous composition formed by plasticising the triblock copolymer of SEBS is removed. This might be achieved by spraying over the moulding a thin layer of lacquer or paint to cover any tacky areas. An alternative method of achieving this might be to spray dry powder over the tacky areas. Another method might be to use a chemical substance to remove the tackiness.

Preferably the first features are raised patterns, such as fins or rods or relief patterns.

Preferably the second features comprise a smooth surface.

Preferably the ball is formed by injection moulding or by cast moulding.

Preferably the thickness of the wall is not less than 4 mm where the diameter of the ball is about 50 mm and SEBS gelatinous composition is used, to thereby retain a substantially spherical shape before and after transformation from inside-in to inside-out.

For a more rigid material such as rubber, the wall thickness may be reduced if desired. Conversely, for very soft material, such as foamed latex, the wall thickness would be increased.

Such a ball, apart from changing appearance when turned inside-out, might function differently. For example, in one configuration, the ball might bounce from a surface, whereas in another configuration the ball might grip to a surface against which it is thrown.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

In FIGS. 1 to 4 of the accompanying drawings there is schematically depicted a transformable ball 10. Ball 10 is typically formed as an integral moulding of self-supporting material. Typically, the material is a gelatinous composition as disclosed above. Examples of such materials are shown in U.S. Pat. No. 4,618,213 to John Y. Chen.

The ball is typically of a size mentioned above and with a wall thickness as also mentioned above. The wall 11 has a hole 12.

Figure 1:
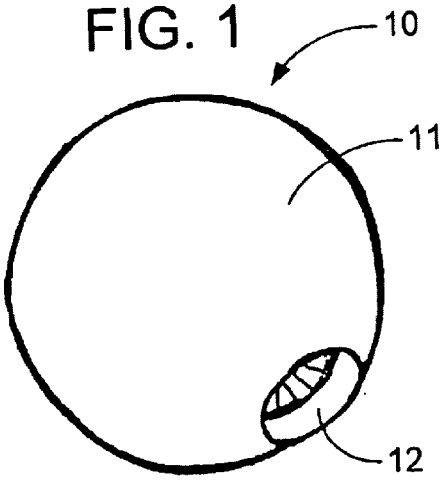
FIG. 1 is a schematic perspective illustration of a ball in a first configuration.
Figure 2:
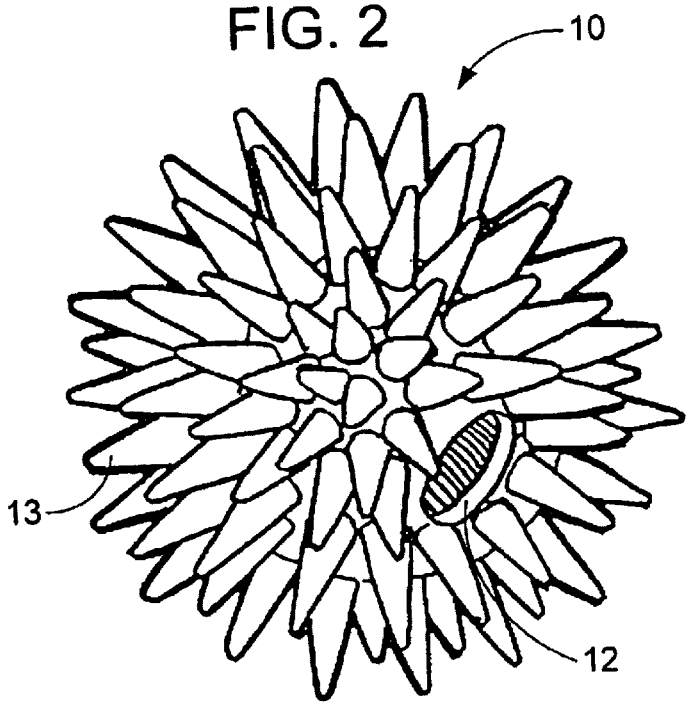
FIG. 2 is a schematic perspective illustration of the ball of FIG. 1 turned inside-out.
Figure 3:
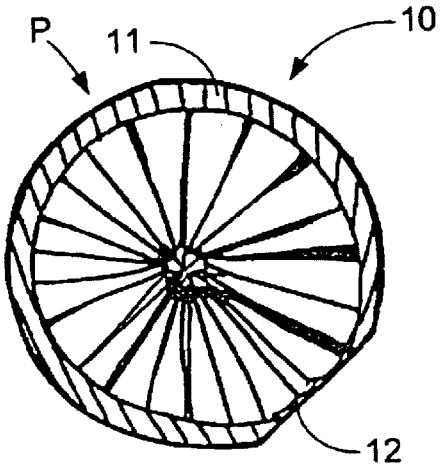
FIG. 3 is a schematic cross-sectional illustration of the ball of FIGS. 1 and 2 in the configuration of FIG. 1.
Figure 4:
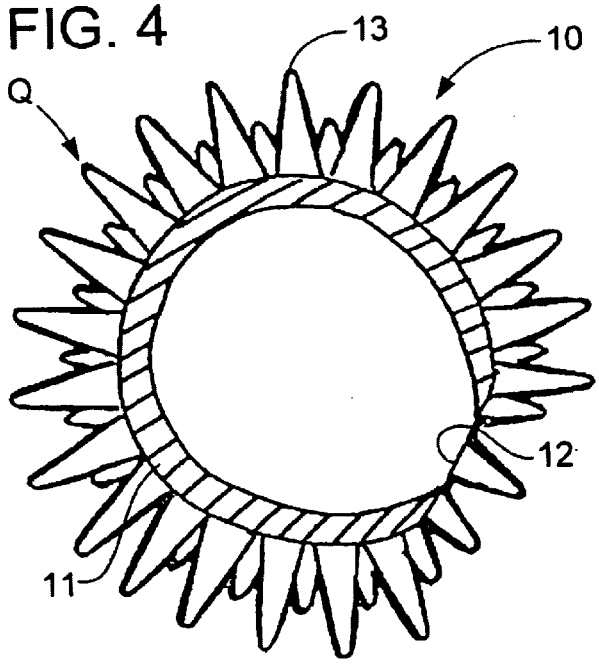
FIG. 4 is a schematic cross-sectional illustration of the ball of FIGS. 1 and 2 in the configuration of FIG. 2.
Figure 5:
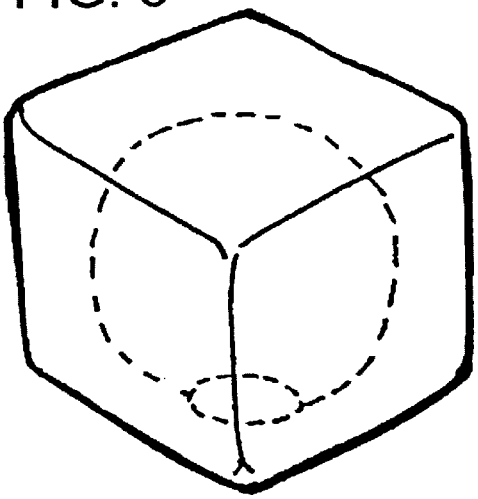
FIG. 5 is a schematic perspective illustration of another ball in a first configuration.
Figure 6:
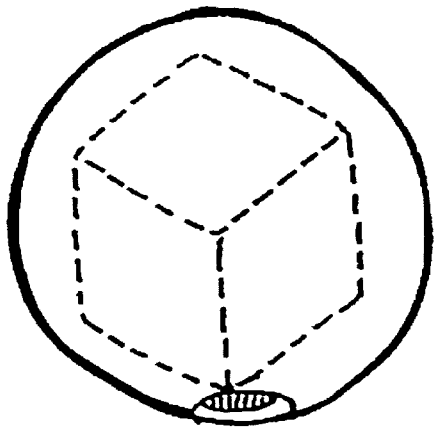
FIG. 6 is a schematic perspective illustration of the ball of FIG. 5 turned inside-out.
Figure 7:
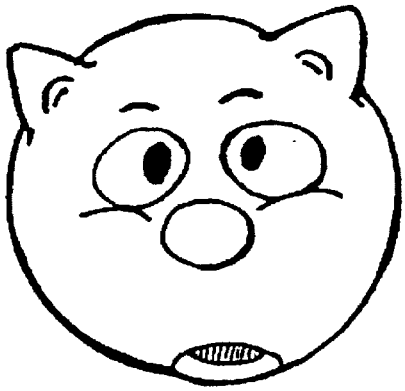
FIG. 7 is a schematic perspective illustration of another ball in a first configuration.
Figure 8:
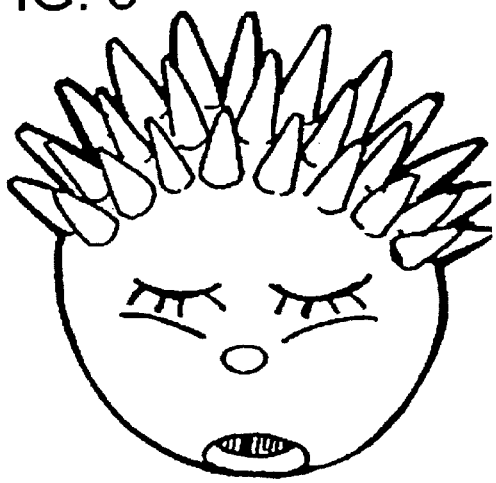
FIG. 8 is a schematic perspective illustration of the ball of FIG. 7 turned inside-out.

Within the ball (in the configuration of FIGS. 1 and 3) there is a space into which a number of spears 13 projecting from a first side of the wall extend. The other side of the wall (the external side) has smooth surface features. The spears can be reconfigured into external features by pushing at P (as shown in FIG. 3) to thereby force all of the spears through the hole 12. The ball would then take on the configuration depicted in FIGS. 2 and 4. The ball can be returned to the configuration of FIGS. 1 and 3 by pushing at Q (as shown in FIG. 4).

Alternative balls are shown in FIGS. 5 to 8 and these can be transformed in a like manner.

It should be appreciated that modifications and alterations obvious to those skilled in the art are not to be considered as beyond the scope of the present invention. For example, the inside or outside surfaces of the wall 3 can be provided with less physically pronounced features such as features of roughness versus smoothness, or features of different colour.

What is claimed is:

1. A recreational ball comprising:

a self-supporting flexible wall substantially surrounding an internal space, one side of the wall having first features that extend into or at least face said internal space, and the other side of the wall having second features at the ball exterior, and a hole in said flexible wall, through which said first features can pass to the ball exterior as the ball is turned inside-out;

wherein the ball is made of a highly elastic material that is a gelatinous composition produced by a melt blend of a copolymer and plasticising oils.

2. The ball of claim 1, wherein the first features are of different overall appearance than the second features.

3. The ball of claim 1, wherein the copolymer is poly (styrene-ethylene-butylene-styrene)triblock copolymer.

4. The ball of claim 1, wherein tackiness or stickiness in the gelatinous composition is removed.

5. The ball of claim 4, wherein said removal is achieved by spraying dry powder over tacky areas.

6. The ball of claim 4, wherein a chemical substance has removed tackiness.

7. The ball of claim 1, wherein the first features are fins.

8. The ball of claim 1, wherein the second features comprise a smooth surface.

9. The ball of claim 1 formed by injection moulding.

10. The ball of claim 3, having a diameter of about 50 mm and wherein the wall is not less than 4 mm thick.

11. The ball of claim 1, wherein the first features are rods.

12. The ball of claim 1, wherein the first features are relief patterns.

13. The ball of claim 1, formed by injection moulding.

* * * * *